US006585142B1

(12) United States Patent
Chen

(10) Patent No.: US 6,585,142 B1
(45) Date of Patent: Jul. 1, 2003

(54) HAMMER HEAD ASSEMBLY USED IN AN AIR NAILING GUN FOR DRIVING U-NAILS

(76) Inventor: Tung-Hsien Chen, 2/F-3, No. 73, Chiaohsiao St., Keelung City (TW)

( * ) Notice: Subject to any disclaimer, the term of this patent is extended or adjusted under 35 U.S.C. 154(b) by 0 days.

(21) Appl. No.: 10/307,341

(22) Filed: Dec. 2, 2002

(51) Int. Cl.[7] ..... B25C 1/04
(52) U.S. Cl. ..... 227/130; 227/113
(58) Field of Search ..... 227/130, 113, 227/147, 10, 119; 173/132, 114

(56) References Cited

U.S. PATENT DOCUMENTS 3,434,643 A * 3/1969 Wandel ..... 227/130
3,438,449 A * 4/1969 Smith ..... 227/130
3,730,044 A * 5/1973 Sawdon ..... 227/130
3,776,444 A * 12/1973 Kuehn et al. ..... 227/130
3,813,993 A * 6/1974 Smith ..... 91/220
4,215,808 A * 8/1980 Sollberger et al. ..... 227/130
6,138,888 A * 10/2000 Liao ..... 173/132

* cited by examiner

*Primary Examiner*—Scott A. Smith
(74) *Attorney, Agent, or Firm*—Rosenberg, Klein & Lee

(57) ABSTRACT

A hammer head assembly installed in an air nailing gun to guide a striking rod to drive a U-nail into a wooden material to fix a cord member to the wooden material is constructed to include a hollow mounting base fastened to the air nailing gun, a sliding sleeve moved in and out of the bottom end of the mounting base, a nail holder coupled to the bottom end of the sliding sleeve by a coupling nut and adapted to hold a U-nail in a flat receiving slot thereof for fastening, magnets mounted in the nail holder for securing the loaded U-nail in position for driving, and a hammer rod supported on a spring inside the sliding sleeve for driving by the striking rod of the air nailing gun to force the loaded U-nail out of the nail holder into the wooden material to fix a cord member to the wooden material.

8 Claims, 8 Drawing Sheets

HAMMER HEAD ASSEMBLY USED IN AN AIR NAILING GUN FOR DRIVING U-NAILS

BACKGROUND OF THE INVENTION

1. Field of the Invention

The present invention relates to an air nailing gun adapted to drive U-nails into a post or the like to fasten a cord member to the post and, more specifically, to a hammer head assembly for use in such an air nailing gun.

2. Description of the Related Art

In ranches or barns, people may set up wooden posts 4 around the boundary, and then fasten steel ropes 5 to the posts 4 with U-nails 2 to build a fence (see FIG. 3). However, it is not easy to drive U-nails 2 into wooden posts 4 accurately. Because there isn't any tool specifically designed for driving this kind of U-nails into wooden materials, people usually use a hammer to drive this kind of U-nails into wooden materials. However, because the two pointed ends respectively sloping outwards, they tend to be deformed when driving into the workpiece. Further, during hammering, the hammer may strike against the fingers holding the U-nail accidentally, causing an injury.

SUMMARY OF THE INVENTION

The present invention has been accomplished under the circumstances in view. It is one object of the present invention to provide a hammer head assembly for air nailing gun, which is specifically designed for driving U-nails into wooden materials. It is another object of the present invention to provide a hammer head assembly for air nailing gun, which positively holds the loaded U-nail in position for driving. To achieve these and other objects of the present invention, the hammer head assembly comprises an externally threaded, stepped, hollow, cylindrical mounting base fastened to the air nailing gun, the mounting base having a center through hole axially extended through top and bottom ends thereof for the passing of the striking rod of the air nailing gun; a sliding sleeve inserted into the center through hole of the mounting base and partially extended out of the bottom end of the mounting base, the sliding sleeve having a center through hole axially extended through top and bottom ends thereof for the passing of the striking rod of the air nailing gun, and an outward stop flange extended from the periphery of the bottom end thereof; a first spring member mounted in the mounting base and adapted to impart a forward pressure to the sliding sleeve; a coupling nut sleeved onto the sliding sleeve and stopped above the outward stop flange of the sliding sleeve outside the mounting base, the coupling nut having an inner thread; a nail holder adapted to hold a U-nail for fastening, the nail holder having an outer thread threaded into the inner thread of the coupling nut, a flat receiving slot extended to a bottom side thereof and adapted to receive a U-nail for fastening, and a top insertion hole disposed in a top side thereof in communication with the flat receiving slot; a hammer rod mounted in the sliding sleeve and aimed at the top insertion hole of the nail holder for driving by the striking rod of the air nailing gun to force a loaded U-nail out of the nail holder into a wooden material; and a second spring member mounted inside the sliding sleeve and adapted to push the hammer rod toward the striking rod of the air nailing gun.

DETAILED DESCRIPTION OF THE PREFERRED EMBODIMENT

Figure 1:
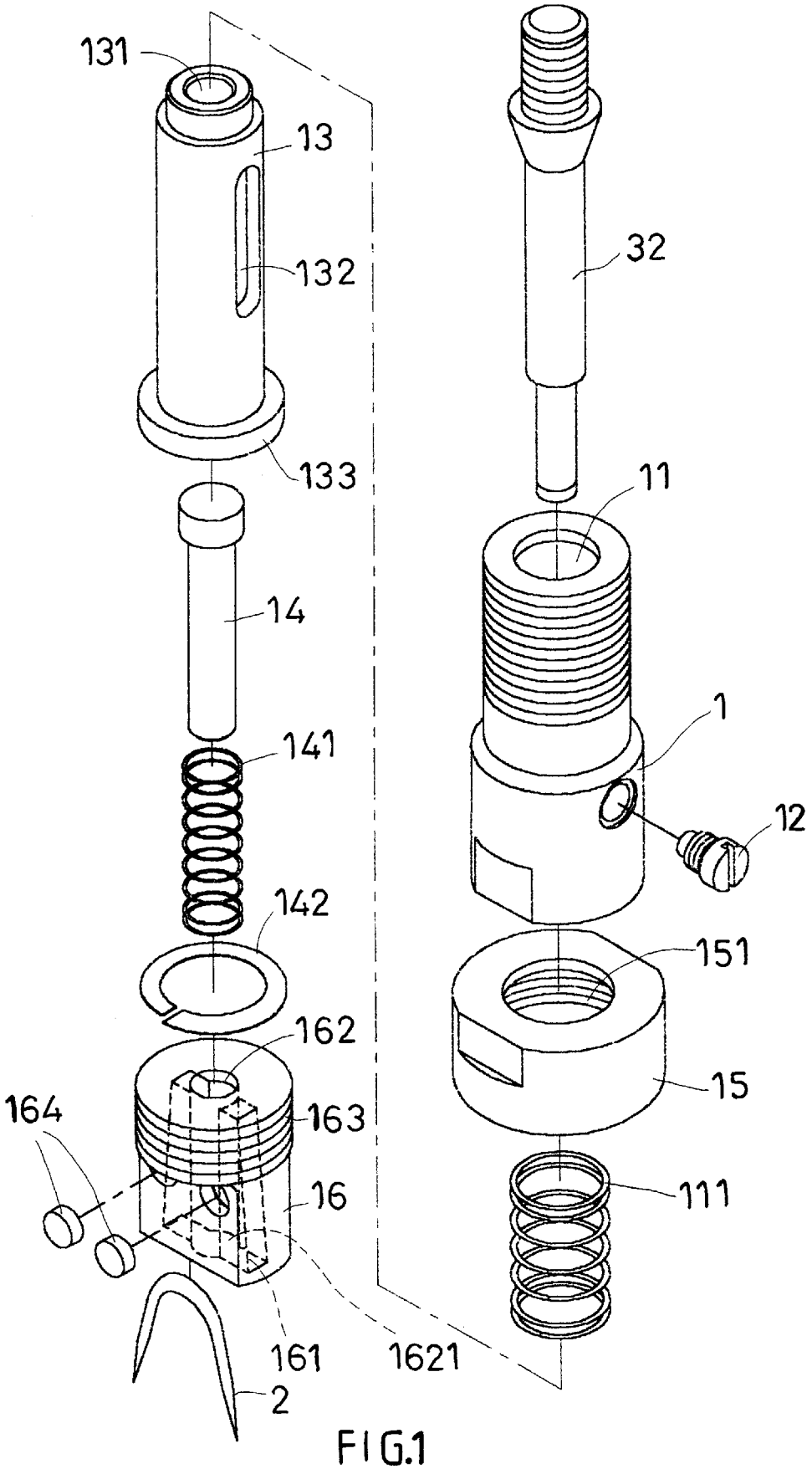
FIG. 1 is an exploded view of a hammer head assembly for air nailing gun according to the first embodiment of the present invention.
Figure 2:
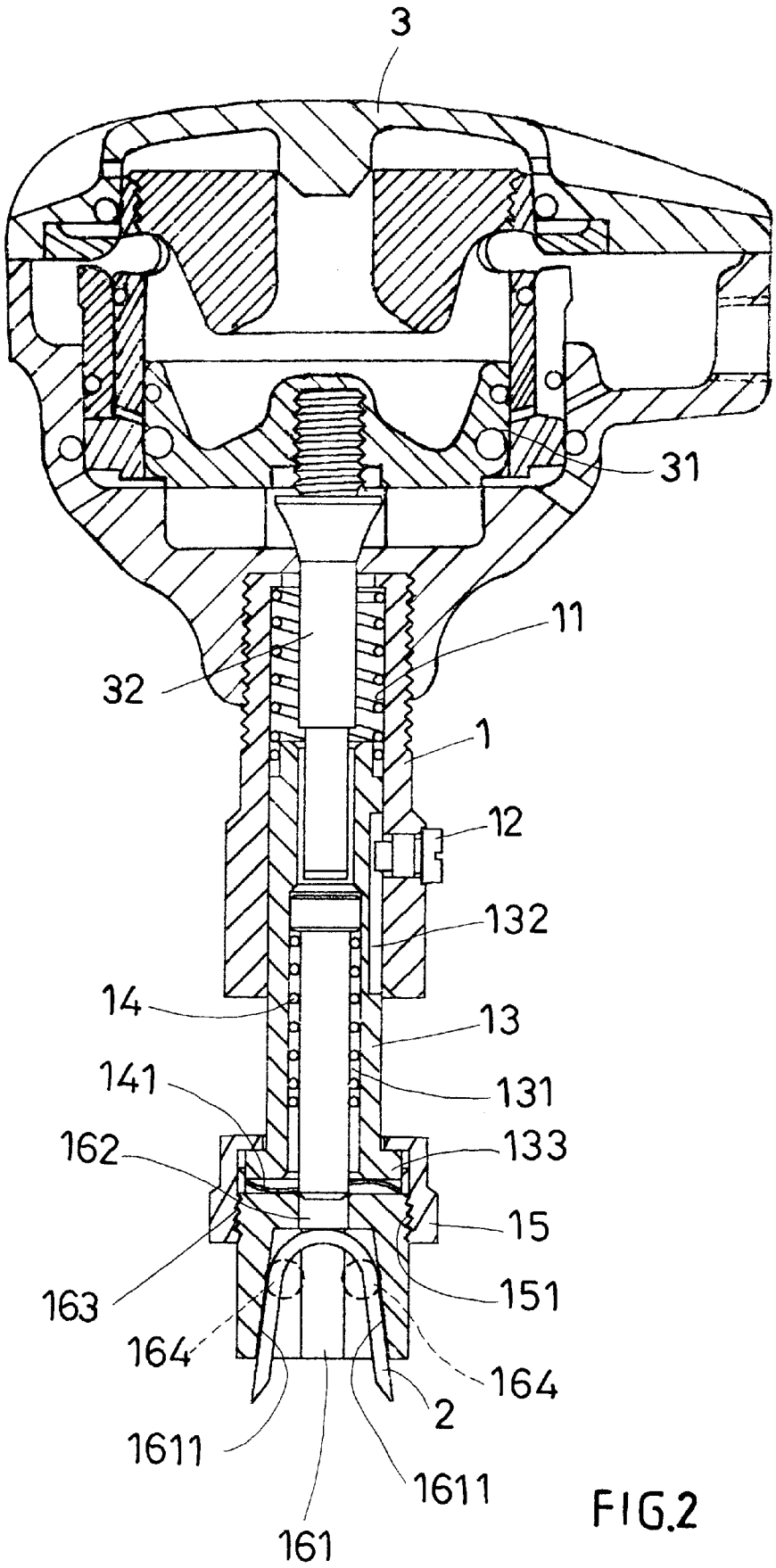
FIG. 2 is a sectional view showing the hammer head assembly installed in an air nailing gun according to the first embodiment of the present invention.
Figure 3:
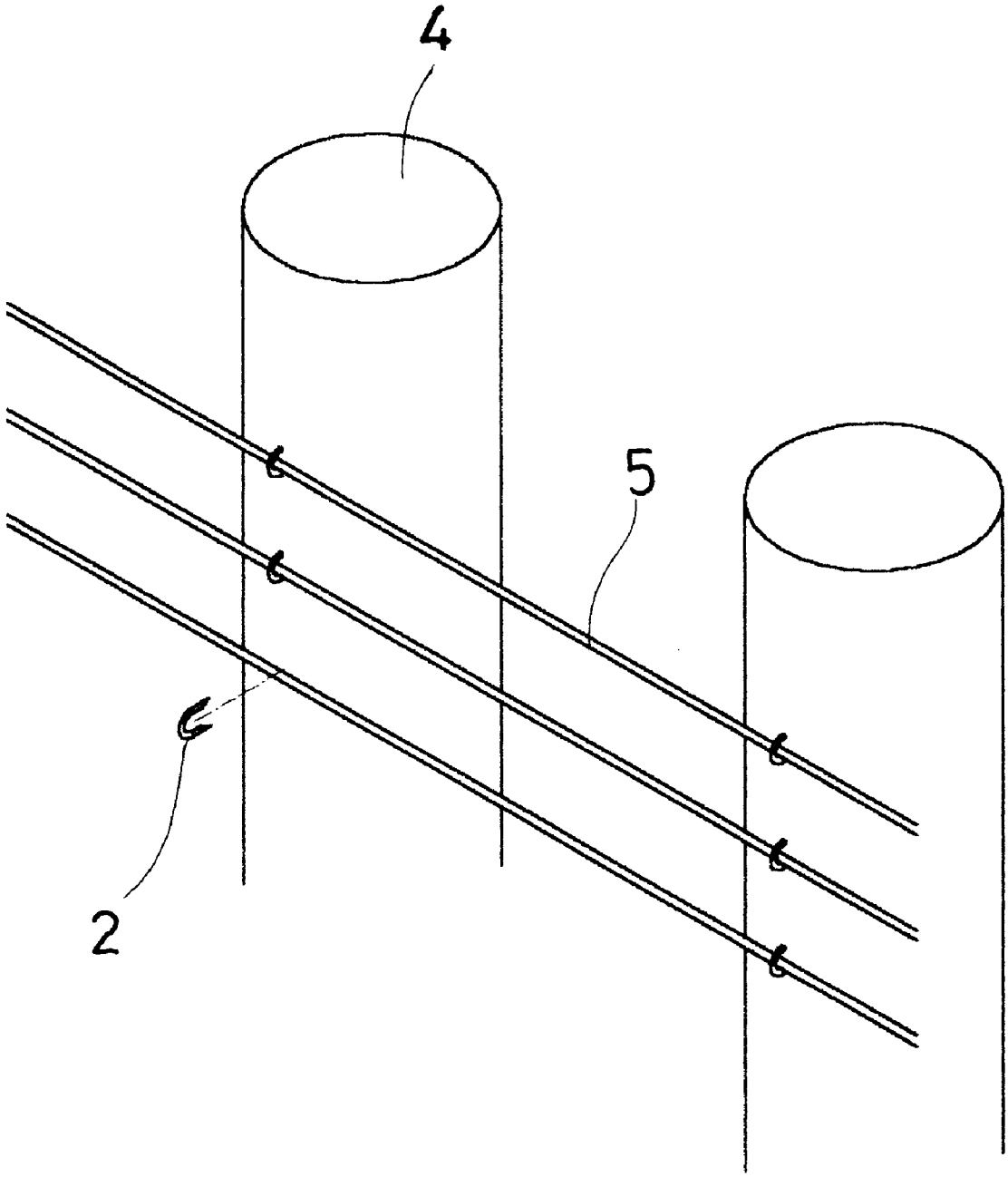
FIG. 3 is a schematic drawing showing steel cord members fastened to wooden posts with U-nails.

Referring to FIGS. 1 and 2, a hammer head assembly in accordance with the present invention is shown used in an air nailing gun 3, and adapted to drive U-nails 2 into wooden materials to fix cord members. The hammer head assembly comprises a mounting base 1, a first spring member 111, a second spring member 141, a sliding sleeve 13, a hammer rod 14, a retaining split ring 142, a coupling nut 15, and a nail holder 16

The mounting base 1 is an externally threaded, stepped, hollow, cylindrical member threaded into a bottom mounting hole (not shown) in the head of an air nailing gun 3 around a striking rod 32 being connected to the piston 31 of the air nailing gun 3, having a center through hole 11 axially extended through the top and bottom ends thereof and a locating screw 12 transversely disposed at one side and partially perpendicularly inserted into the center through hole 11. The sliding sleeve 13 is inserted into the center through hole 11 of the mounting base 1 from the bottom side, having a center through hole 131 axially extended through the top and bottom ends thereof for receiving the striking rod 32 of the air nailing gun 3, a longitudinal sliding slot 132, which receives the locating screw 12 of the mounting base 1 to limit axial movement of the sliding sleeve 13 relative to the mounting base 1 to a limited range, and an outward stop flange 133 extended around the periphery of the bottom end. The first spring member 111 is mounted in the mounting base 1 and stopped between a top part of the mounting base 1 and a top part of the sliding sleeve 13 to impart a forward pressure to the sliding sleeve 13. The coupling nut 15 is sleeved onto the sliding sleeve 13 and stopped above the outward stop flange 133 of the sliding sleeve 13 outside the mounting base 1 to secure the nail holder 16 to the sliding sleeve 13, having an inner thread 151. The nail holder 16 has an outer thread 163 threaded into the inner thread 151 of the coupling nut 15, a flat receiving slot 161 extended to the bottom side and adapted to receive a U-nail 2 for fastening, a top insertion hole 162 disposed in the top side in communication with the flat receiving slot 161 for the passing of the hammer rod 14 to drive the loaded U-nail 2 out of the nail holder 16 into the workpiece, and a plurality of magnets 164 fixedly provided inside the flat receiving slot 161 to securing the loaded U-nail 2 in position for driving, a bottom center hole 1621 coincided with the center of the bottom end of the flat receiving slot 161 in vertical alignment with the top insertion hole 162 for the passing of the hammer rod 14. The flat receiving slot 161 has two sloping sidewalls 1611 adapted to support the two sloping arms of the loaded U-nail 2, keeping the loaded U-nail 2 in position for driving. The hammer rod 14 is mounted in the sliding sleeve 13, and aimed at the top insertion hole 162 of the nail holder 16 for driving by the striking rod 32 of the air nailing gun 3 to force the loaded U-nail 2 out of the nail holder 16 into the workpiece. The second spring member 41 is mounted inside the sliding sleeve 13 and connected between a lower part of the sliding sleeve 13 and the headed top end of the hammer rod 14 to impart an upward pressure to the hammer rod 14. Further, the retaining split ring 142 is fastened to the inside of the coupling nut 15 to secure the coupling nut 15 to the sliding sleeve 13.

Figure 4:
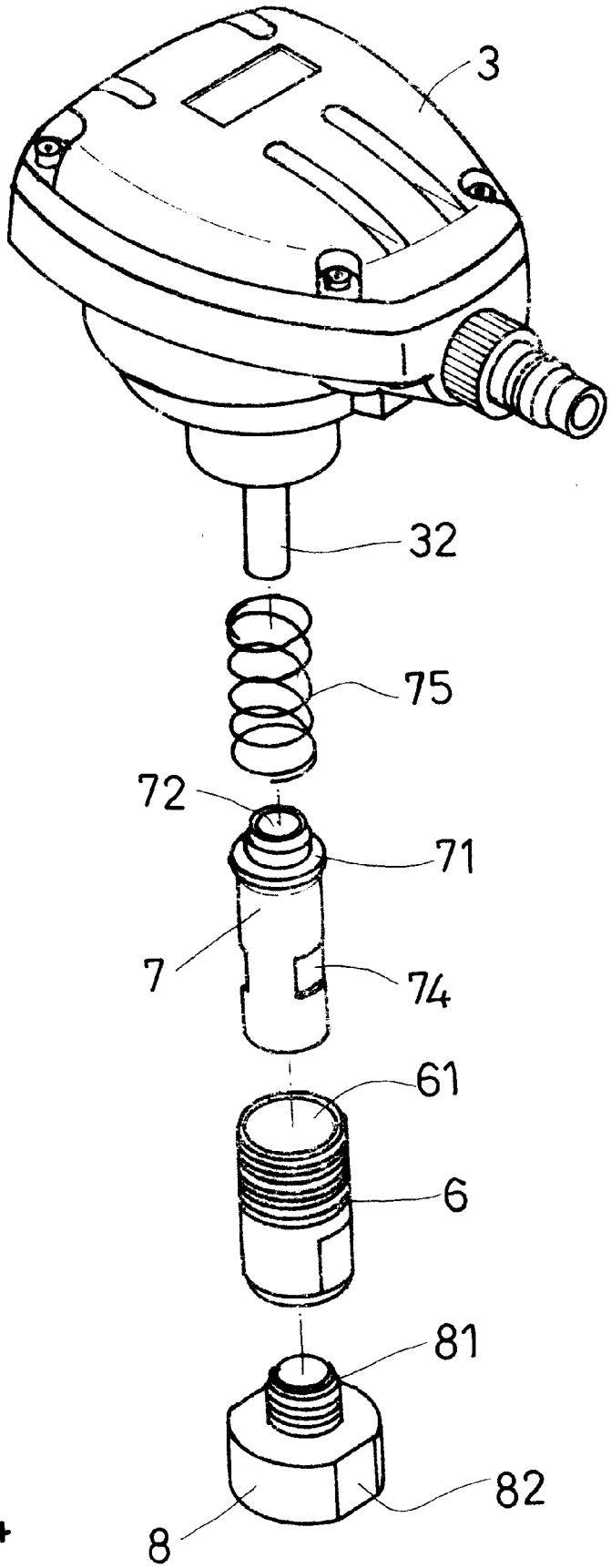
FIG. 4 is an exploded view of the second embodiment of the present invention.
Figure 5:
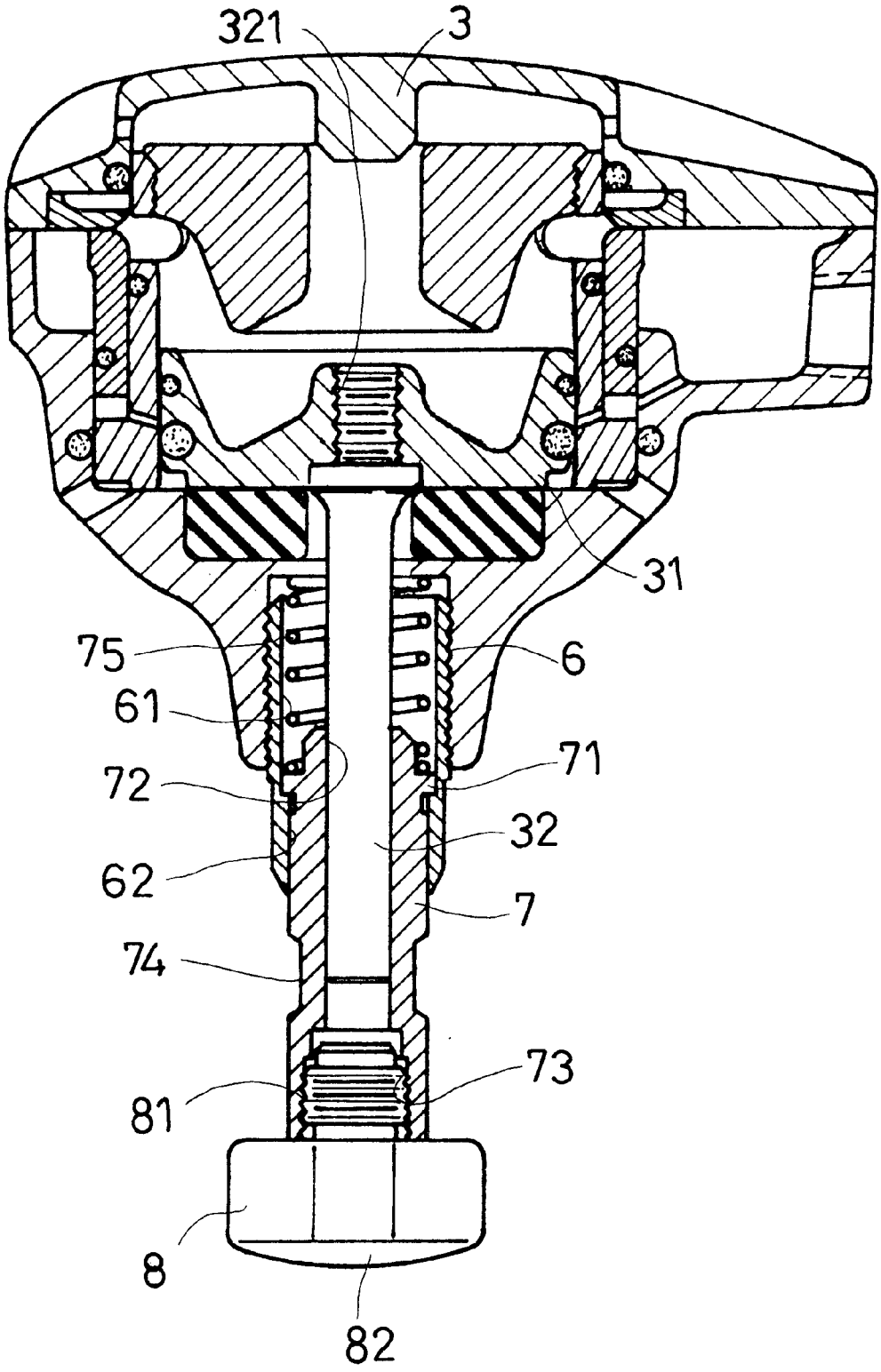
FIG. 5 is a sectional assembly view of the second embodiment of the present invention.

FIGS. 4 and 5 show the second embodiment of the present invention. According to this embodiment, the hammer head assembly comprises a mounting base 6, a sliding sleeve 7, a spring member 75, and a tool bit 8. The mounting base 6 is an externally threaded hollow cylindrical member threaded into the a bottom mounting hole (not shown) in the head of an air nailing gun 3 around a striking rod 32 being connected to the piston 31 of the air nailing gun 3, having a center through hole 61 axially extended through the top and bottom ends thereof and an inside annular stop flange 62 in the bottom end. The sliding sleeve 7 is inserted through the center through hole 61 of the mounting base 6 from the top, having a center through hole 72 axially extended through the top and bottom ends thereof for the passing of the striking rod 32 of the air nailing gun 3, an outward stop flange 71 extended around the periphery of the top end and moved with the sliding sleeve 7 above the inside annular stop flange 62 of the mounting base 6, and an inner thread 73 in the bottom end around the center through hole 72. The spring member 75 is mounted within the mounting base 6 to impart a forward pressure to the sliding sleeve 7. The tool bit 8 has a threaded shank 81 threaded into the inner thread 73 of the sliding sleeve 7.

Figure 6:
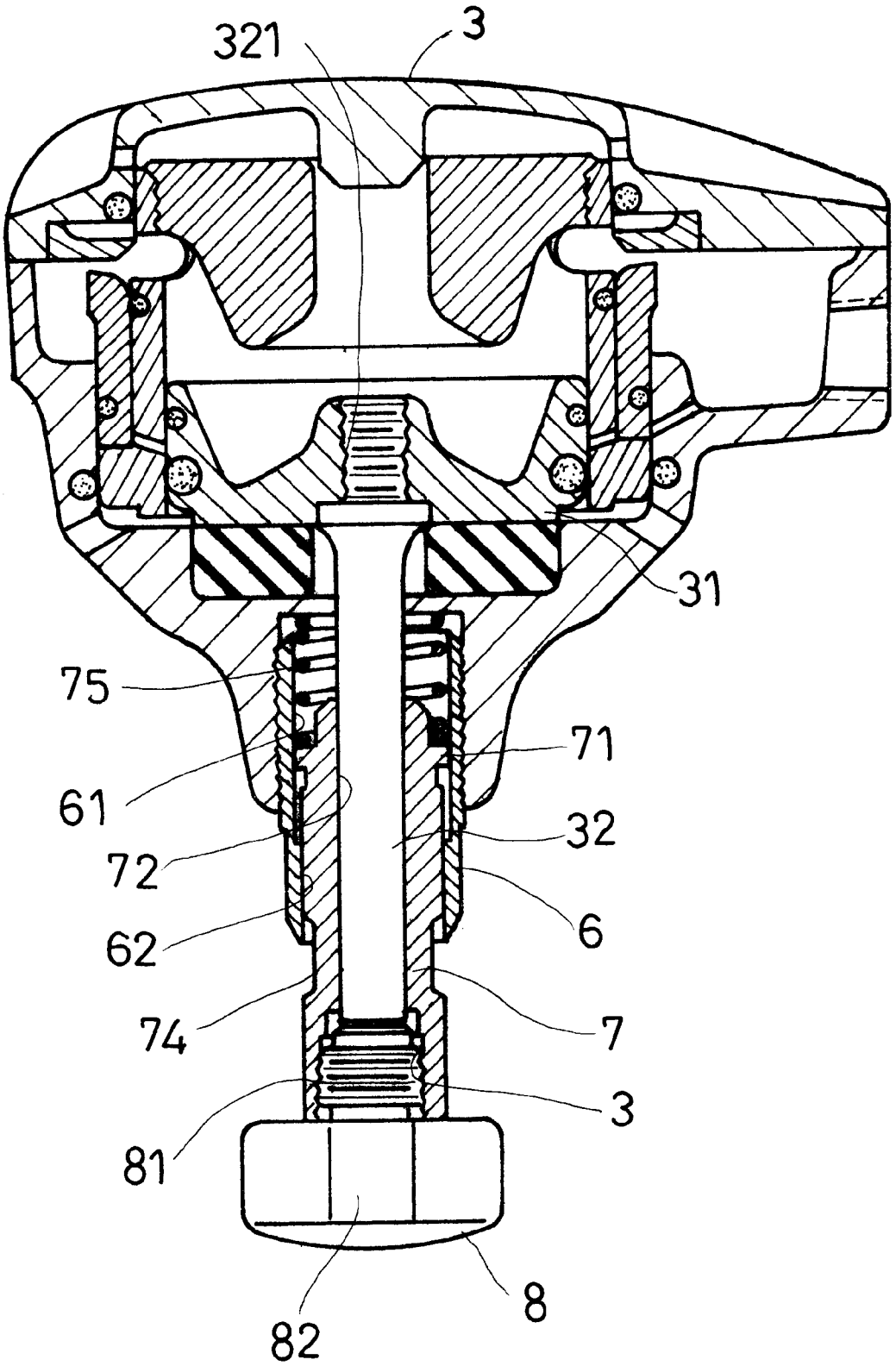
FIG. 6 is similar to FIG. 5 but showing the sliding sleeve moved with the tool bit backwards against the spring member, the tool bit spaced from the striking rod at a distance.
Figure 7:
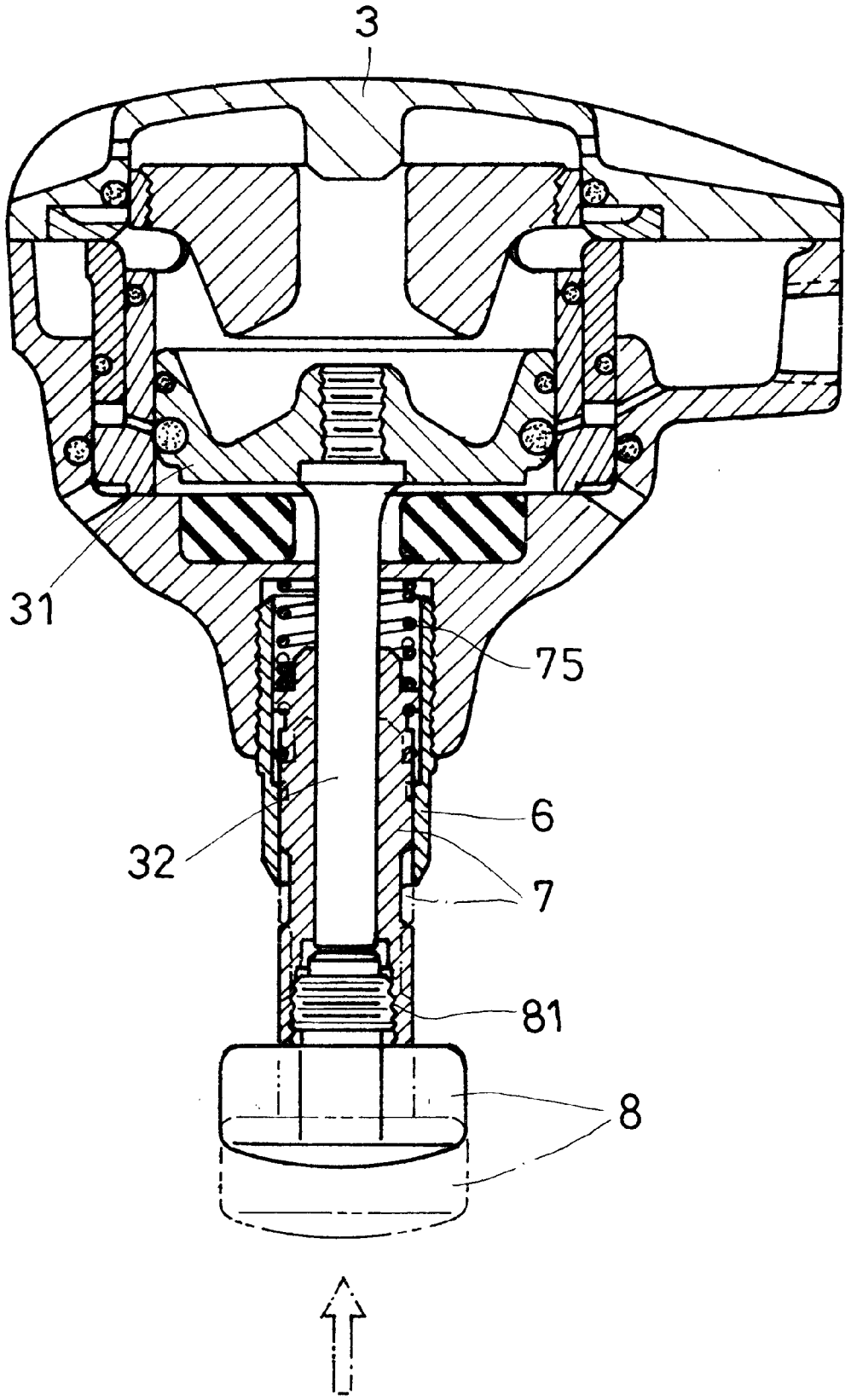
FIG. 7 is a schematic sectional view showing the tool bit moved between the operative position and the non-operative position according to the second embodiment of the present invention.

Referring to FIGS. 6 and 7, when the air nailing gun 3 pressed on the workpiece, the tool bit 8 forces the sliding sleeve 7 against the spring member 75. At this time, the top end of the threaded shank 81 of the tool bit 8 is maintained spaced from the striking rod 32 at a distance, and the striking rod 32 is not pushed (see FIG. 6). Therefore, the operator has sufficient time to adjust the position of the air nailing gun 3 and to correct the alignment between the tool bit 8 and the workpiece. When increasing the pressure to the tool bit 8 against the workpiece, the threaded shank 81 of the tool bit 8 is forced to push the striking rod 32 backwards, thereby causing the air nailing gun 3 to be switched on to reciprocate the piston 31 against the tool bit 8 and the workpiece (see FIG. 7). Because the sliding sleeve 7 guides reciprocating motion of the striking rod 32, continuously strike the striking rod 32 against the tool bit 8 does not damage the connection portion 321 of the striking rod 32. When the operator removed the air nailing gun 3 from the workpiece, the spring member 75 immediately pushes the sliding sleeve 7 forwards, keeping the tool bit 8 spaced from the striking rod 32, and therefore the air nailing gun 3 is switched off.

Further, the sliding sleeve 7 and the tool bit 8 have cut planes 74 or 82 symmetrically disposed at two opposite lateral sides for the gripping of a tool during installation.

Figure 8:
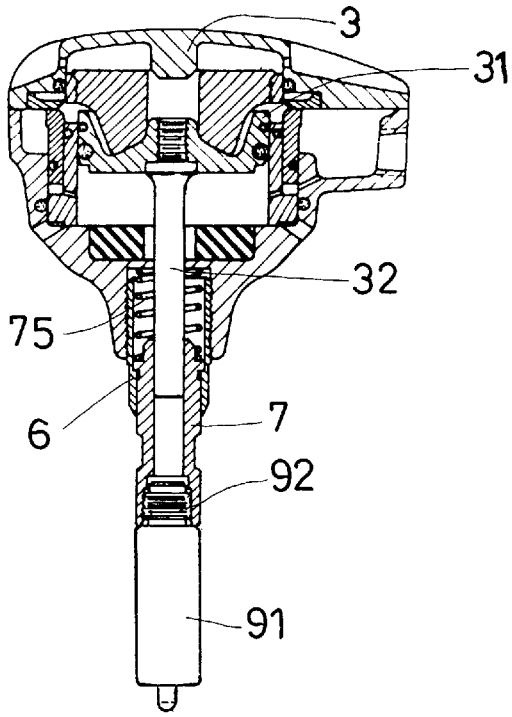
FIG. 8 is a sectional view showing an alternate form of the tool bit according to the present invention.
Figure 9:
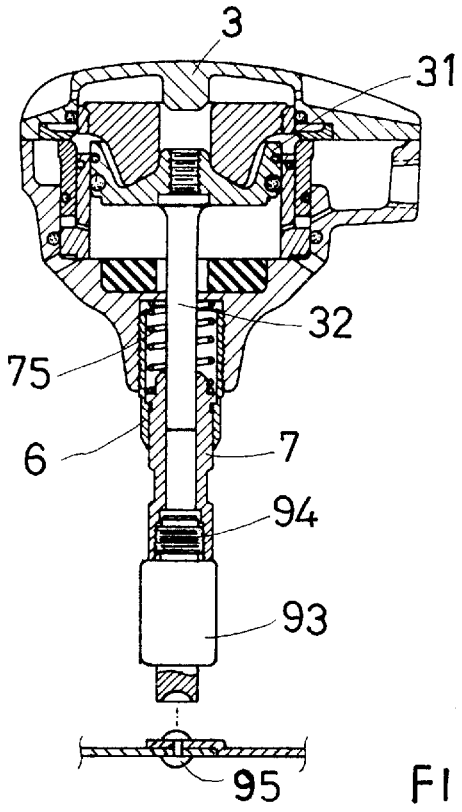
FIG. 9 is a sectional view showing another alternate form of the tool bit according to the present invention.

The aforesaid second embodiment may be attached with any of a variety of tool bits. FIGS. 8 and 9 show two different alternate forms of the tool bit. According to the embodiment shown in FIG. 8, the tool bit 91 has a threaded shank 92 for threading into the inner thread of the sliding sleeve 7, and is adapted to drive a hollow nail. According to the embodiment shown in FIG. 9, the tool bit 93 has a threaded shank 94 for threading into the inner thread of the sliding sleeve 7, and is adapted to hammer down a rivet 95.

A prototype of hammer head assembly for use in an air nailing gun has been constructed with the features of FIGS. 1 and 2. The hammer head assembly for use in an air nailing gun functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A hammer head assembly installed in an air nailing gun to guide a striking rod of the air nailing gun to drive a U-nail into a wooden material, comprising:

an externally threaded, stepped, hollow, cylindrical mounting base fastened to the air nailing gun, said mounting base having a center through hole axially extended through top and bottom ends thereof for the passing of the striking rod of said air nailing gun;

a sliding sleeve inserted into the center through hole of said mounting base and partially extended out of the bottom end of said mounting base, said sliding sleeve having a center through hole axially extended through top and bottom ends thereof for the passing of the striking rod of said air nailing gun, and an outward stop flange extended from the periphery of the bottom end thereof;

a first spring member mounted in said mounting base and adapted to impart a forward pressure to said sliding sleeve;

a coupling nut sleeved onto said sliding sleeve and stopped above the outward stop flange of said sliding sleeve outside said mounting base, said coupling nut having an inner thread;

a nail holder adapted to hold a U-nail for fastening, said nail holder having an outer thread threaded into the inner thread of said coupling nut, a flat receiving slot extended to a bottom side thereof and adapted to receive a U-nail for fastening, and a top insertion hole disposed in a top side thereof in communication with said flat receiving slot;

a hammer rod mounted in said sliding sleeve and aimed at the top insertion hole of said nail holder for driving by the striking rod of said air nailing gun to force a loaded U-nail out of said nail holder into a wooden material; and a second spring member mounted inside said sliding sleeve and adapted to push said hammer rod toward the striking rod of said air nailing gun.

2. The hammer head assembly as claimed in claim 1 wherein the flat receiving slot of said nail holder having two sloping sidewalls fitting the profile of the U-nail to be loaded in said nail holder for fastening.

3. The hammer head assembly as claimed in claim 1 wherein said nail holder further comprises a plurality of magnets fixedly provided inside said flat receiving slot for securing the loaded U-nail in position for driving.

4. The hammer head assembly as claimed in claim 1 wherein said sliding sleeve has a longitudinal sliding slot, and said mounting base has a locating screw inserted into the longitudinal sliding slot of said sliding sleeve to limit axial movement of said sliding sleeve to a predetermined range.

5. The hammer head assembly as claimed in claim 1 wherein said nail holder has a bottom center hole coincided with the center of a bottom end of said flat receiving slot and aligned with said top insertion hole for the passing of said hammer rod.

6. A hammer head assembly installed in an air nailing gun to guide a striking rod of the air nailing gun to hammer a fastening element, comprising:

an externally threaded, stepped, hollow, cylindrical mounting base fastened to the air nailing gun, said mounting base having a center through hole axially extended through top and bottom ends thereof for the passing of the striking rod of said air nailing gun; and an inside annular stop flange in the bottom end thereof;

a sliding sleeve mounted in said mounting base and partially extended out of the bottom end of said mounting base, said sliding sleeve having a center through hole axially extended through the top and bottom ends thereof for the passing of the striking rod of said air nailing gun, an outward stop flange extended around the periphery of the top end thereof for stopping above the inside annular stop flange of said mounting base, and an inner thread in the bottom end around the center through hole of said sliding sleeve;

a spring member mounted within said mounting base to impart a forward pressure to said sliding sleeve; and a tool bit, said tool bit having a threaded shank threaded into the inner thread of said sliding sleeve.

7. The hammer head assembly as claimed in claim 6 wherein said sliding sleeve has two cut planes symmetrically at two opposite lateral sides for the gripping of a hand tool.

8. The hammer head assembly as claimed in claim 6 wherein said tool bit has two cut planes symmetrically disposed at two opposite lateral sides for the gripping of a hand tool.

* * * * *